US007279053B2

(12) United States Patent
Shimada et al.

(10) Patent No.: US 7,279,053 B2
(45) Date of Patent: Oct. 9, 2007

(54) ALLOY THIN RIBBON FOR RARE EARTH MAGNET, PRODUCTION METHOD OF THE SAME, AND ALLOY FOR RARE EARTH MAGNET

(75) Inventors: Munekatsu Shimada, Hachioji (JP); Hideaki Ono, deceased, late of Yokohama (JP); by Takae Ono, legal representative, Yokohama (JP); Tetsurou Tayu, Yokosuka (JP); Makoto Kano, Yokohama (JP); Hiroshi Yamamoto, Tokyo (JP)

(73) Assignees: Nissan Motor Co., Ltd., Yokohama-shi (JP); Horoshi Yamamoto, Tokyo (JP)

( * ) Notice: Subject to any disclaimer, the term of this patent is extended or adjusted under 35 U.S.C. 154(b) by 0 days.

(21) Appl. No.: 11/207,812

(22) Filed: Aug. 22, 2005

(65) Prior Publication Data

US 2007/0181219 A1 Aug. 9, 2007

(30) Foreign Application Priority Data

Aug. 23, 2004 (JP) ..... 2004-242680

(51) Int. Cl.
*H01F 1/057* (2006.01)

(52) U.S. Cl. ..... 148/101; 164/463; 164/477

(58) Field of Classification Search ..... None
See application file for complete search history.

(56) References Cited

U.S. PATENT DOCUMENTS 5,015,307 A * 5/1991 Shimotomai et al. ..... 148/302
5,454,998 A * 10/1995 Bogatin et al. ..... 419/10
6,302,939 B1 * 10/2001 Rabin et al. ..... 75/338
2004/0079449 A1 * 4/2004 Kanekiyo et al. ..... 148/302

FOREIGN PATENT DOCUMENTS

JP 3277932 B2 1/2002

OTHER PUBLICATIONS

H. Yamamoto et al.—The Journal of Magnetics Society of Japan, 2003, vol. 27, No. 5, pp. 698-703.
English Language Partial Translation for H. Yamamoto et al.—The Journal of Magnetics Society of Japan, 2003, vol. 27, No. 5, pp. 698-703.

* cited by examiner

*Primary Examiner*—John P. Sheehan
(74) *Attorney, Agent, or Firm*—Foley & Lardner LLP

(57) ABSTRACT

The present invention provides a rare earth magnet superior in magnetic properties and thermal stability. In an aspect of the present invention, a production method of an alloy thin ribbon for a rare earth magnet includes a step to obtain a quenched thin ribbon by feeding a molten alloy containing praseodymium (Pr), iron (Fe), cobalt (Co), titanium (Ti), boron (B), and silicon (Si) on a rotating roll and a step to apply heat treatment to the quenched thin ribbon at a heating rate within a range of 100° to 150° C./min to crystallize the quenched thin ribbon.

4 Claims, 13 Drawing Sheets

ALLOY THIN RIBBON FOR RARE EARTH MAGNET, PRODUCTION METHOD OF THE SAME, AND ALLOY FOR RARE EARTH MAGNET

BACKGROUND OF THE INVENTION

1. Field of the Invention

The present invention relates to a rare earth magnet. More specifically, the present invention relates to a technology to improve magnetic properties, in particular, thermal stability of a rare earth magnet.

2. Description of the Related Art

Bonded magnet, which is prepared by compounding magnet powder in a resin or a rubber, is widely used in various applications such as electric appliances and car parts due to freely controllable form and easiness in improving dimensional accuracy.

In recent years, miniaturization and weight reduction of electric appliances and car parts have been demanded, and for bonded magnet that is used for these applications, it has been strongly demanded to realize miniaturization without lowering in their magnetic properties. To respond to this demand, improvement of magnet performance is required. More specifically, it is required to improve residual magnetic flux density and coercive force as well as heighten maximum energy product.

As a measure to enhance magnetic properties, improvements in magnet composition of magnet powder and magnet structure have been proposed. With regard to magnet composition, a ferrite type bonded magnet using a magnetoplumbite type ferrite had been widely used. However, the ferrite type bonded magnet has such magnetic properties that residual magnetic flux density Br, coercive force iHc and maximum energy product (BH)max are comparatively lower. Due to the reason, an $Nd_2Fe_{14}B$ type bonded magnet has been spread. The $Nd_2Fe_{14}B$ type bonded magnet is produced using a quenched thin ribbon that is obtainable by feeding a molten raw alloy on a rotating roll.

With regard to an improvement of magnet structure, an exchange spring magnet, in which a permanent magnet phase (a hard phase) and a soft magnet phase (a soft phase) are coexisting in nano-size, attracts attention as a novel magnet material. The exchange spring magnet can improve magnetic properties due to high magnetic flux density as a whole magnet because it contains a soft phase with a high magnetic flux density.

Enhancements of magnetic properties are progressing by the above-described improvements, whereas a problem has been pointed out that rare earth bonded magnet is inferior in thermal stability. A magnet applied in a site, where the magnet is exposed to such a high temperature environment as for automobile driving system, is particularly required to have superior thermal stability and a small irreversible demagnetizing factor.

As a measure to improve thermal stability of the rare earth bonded magnet, a technology to improve thermal stability by forming a plurality of convex streaks or grooves on the surface of magnet powder has been disclosed (JP-3277932).

However, in consideration of use in such a high temperature environment as for automobile driving system, a further improvement in thermal stability is required.

As other measures to improve thermal stability of the rare earth bonded magnet, a method for improving thermal stability by controlling magnet composition, production conditions of a quenched thin ribbon and heat treatment conditions of a quenched thin ribbon has been developed by one of the present inventors [Hiroshi Yamamoto and Kazuma Takahashi, Journal of The Magnetics Society of Japan, Vol. 27, No. 5, pp. 698-703 (2003)]. In the above-mentioned Reference, for a Pr—Fe—Co—Ti—Si—B type of exchange spring magnet, influences of each of magnet composition, roll circumferential speed in producing a quenched thin ribbon, heat treatment conditions of a quenched thin ribbon and heat treatment time of a quenched thin ribbon on magnetic properties have been studied by varying these factors.

However, in consideration of use in applications where the magnet is exposed to a high temperature environment, a further improvement of thermal stability is preferable.

SUMMARY OF THE INVENTION

Namely, it is an object of the present invention to provide a rare earth magnet superior in magnetic properties and thermal stability.

In an aspect of the present invention, a method for producing an alloy thin ribbon for a rare earth magnet includes a step to obtain a quenched thin ribbon by feeding a molten alloy containing praseodymium (Pr), iron (Fe), cobalt (Co), titanium (Ti), boron (B), and silicon (Si) on a rotating roll and a step to apply heat treatment to the quenched thin ribbon at a heating rate within a range of 100 to 150° C./min to crystallize the quenched thin ribbon.

According to the present invention, a rare earth bonded magnet superior in magnetic properties and thermal stability can be provided.

The bonded magnet of the present invention can be widely used in the applications such as permanent magnet motors loaded on automobiles, and spindle motors and stepping motors for various OA tools. The bonded magnet of the present invention is preferably applied to permanent magnet motors to be loaded on automobiles, which are used in a high temperature environment. Specifically, these motors include, for example, a linear motor for power-curtain, a motor for opening/closing sun roof, a motor for power-window, a motor for wiper, a motor for power-mirror housing, a motor for controlling power-mirror and steering actuator.

DESCRIPTION OF THE PREFERRED EMBODIMENTS

Figure 1:
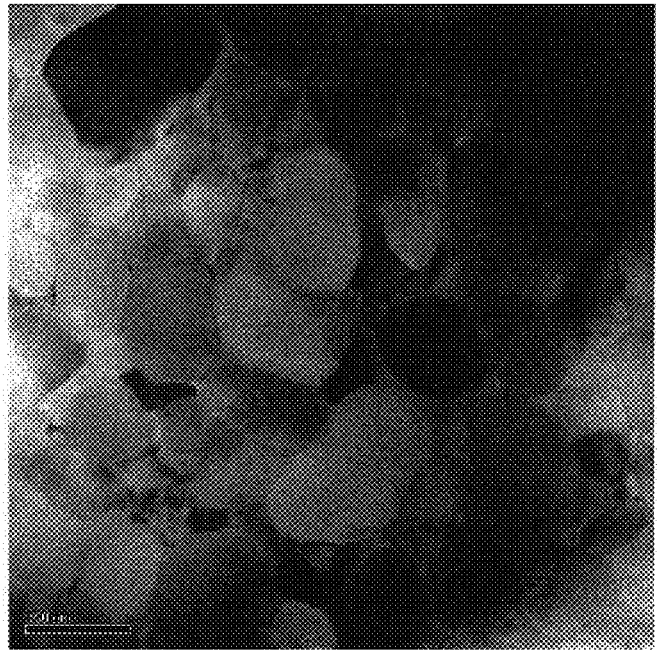
FIG. 1 is a TEM photograph of an alloy thin ribbon in a composition where boron concentration is higher ($Pr_{13}$, $B_{14}$).

A first aspect of the present invention relates to a production method of an alloy thin ribbon for a rare earth magnet. Specifically, in the first aspect of the present invention, the production method of an alloy thin ribbon for a rare earth magnet includes a step to obtain a quenched thin ribbon by feeding a molten alloy containing praseodymium (Pr), iron (Fe), cobalt (Co), titanium (Ti), boron (B), and silicon (Si) on a rotating roll and a step to apply heat treatment to the quenched thin ribbon at a heating rate within a range of 100° to 150° C./min to crystallize the quenched thin ribbon.

We have found out that a magnet superior in thermal stability can be obtained by using a Pr—Fe—Co—Ti—B—Si type magnet and by controlling heating rate in a heat treatment step within a certain range. The production method of the present invention will be explained in detail below.

Firstly, raw materials of an alloy are dissolved to prepare a mother alloy, which is molten and fed on a rotating roll to obtain a quenched thin ribbon. It is well known that a ribbon-like alloy thin ribbon is prepared by quenching a molten alloy using a liquid quenching method, in which the molten alloy is sprayed on a rotating roll, and the liquid quenching method is employed also in the present invention. In using the liquid quenching method, type thereof, roll material, roll size, and the like are not specially limited. For example, a Cr-plated copper roll can be used. Roll size may be determined depending on a production scale.

Raw materials of alloy to be used are determined depending on a composition of the alloy thin ribbon. Raw materials may be compounded so that a desired composition is obtained. The alloy thin ribbon for rare earth magnet of the present invention uses a Pr—Fe—Co—Ti—B—Si type magnet. By using the composition of Pr—Fe—Co—Ti—B—Si, a rare earth magnet alloy superior in thermal stability can be obtained. To obtain a Pr—Fe—Co—Ti—B—Si type magnet, raw materials of alloy may be compounded so that Pr, Fe, Co, Ti, B, and Si are contained in the alloy thin ribbon. Other elements may be contained to improve magnetic properties, if necessary. Since the alloy thin ribbon is made of alloy materials, contamination of a small quantity of impurity is unavoidable, but less impurity is more preferable, and the impurity is preferably less than 1% by weight.

Composition of the alloy thin ribbon is preferably $Pr_xFe_{90-x-z}Co_yTi_{1.5}B_zSi_{0.5}$ (x=10.0 to 13.0, y=8.0 to 12.0, and z=7.0 to 14.0). A composition of alloy thin ribbon within this range provides an alloy thin ribbon superior in residual magnetic flux density (Br), coercive force (HcJ; HcB), and maximum energy product [(BH)max]. In the alloy thin ribbon, contamination of some amount of impurity is unavoidable due to the nature of alloy. Therefore, in the present invention, "composition of an alloy thin ribbon" means a composition of other components excluding contaminated impurity.

Composition of an alloy can be measured by using a measuring apparatus such as an inductive coupling plasma emission spectroscopic analyzer. Composition of an alloy can also be estimated from compounding ratio of alloy materials used.

In the liquid quenching method, a quenched thin ribbon is obtained by feeding a molten alloy on a rotating roll, where roll circumferential speed is preferably 7.5 to 15 m/sec. Roll circumferential speed within this range enables to obtain an alloy superior in magnetic properties such as residual magnetic flux density (Br), coercive force (HcJ; HcB), and maximum energy product [(BH)max].

The quenched thin ribbon is crystallized by heat treatment. Magnetic properties of an alloy to be obtained vary depending on heat treatment conditions for crystallization, and it has been found that thermal stability can be greatly improved by controlling heating rate within a certain range. In the present invention, the quenched thin ribbon is crystallized by applying heat treatment to the quenched thin ribbon at a programming rate within a range of 100° to 150° C., preferably 110° to 125° C. By applying heat treatment at such a programming rate, a magnet alloy superior in magnetic properties such as coercive force can be obtained.

Furthermore, it is possible to lower irreversible demagnetization rate of a magnet to be produced at a high temperature. That is, a magnet, whose magnetic properties hardly show deterioration even when used in a high temperature environment, can be obtained.

Heat treatment of the quenched thin ribbon is preferably conducted by using an apparatus that can realize a high heating rate. For example, an infrared ray gold image furnace is used.

Heat treatment temperature in the heat treatment is preferably 550° to 625° C. Heat treatment at a temperature within this range enables to obtain an alloy superior in magnetic properties such as residual magnetic flux density (Br), coercive force (HcJ; HcB), and maximum energy product [(BH)max].

Heat treatment time in the heat treatment is preferably 3 to 7 minutes. Heat treatment time within this range enables to obtain an alloy superior in magnetic properties such as residual magnetic flux density (Br), coercive force (HcJ; HcB), and maximum energy product [(BH)max]. The heat treatment time here means a period for which the quenched thin ribbon is maintained in the desired heat treatment temperature range. For example, in a case where the heat treatment temperature is 600° C., if a quenched thin ribbon is maintained at 600° C. for 3 minutes followed by cooling, the heat treatment time is 3 minutes. Since it is difficult, in the heat treatment, to keep the temperature constant correctly, some allowable range of temperature should be considered in calculation of the heat treatment time. In the present invention, variation of temperature within a range of ±3° C. is allowed in calculation of the heat treatment time. For example, in a case where the desired heat treatment temperature is 600° C., the total time within a temperature range of 600° C.±3° C. becomes the heat treatment time.

An alloy thin ribbon, which becomes raw material of rare earth magnet, is obtained by the heat treatment, and preferably the alloy thin ribbon is an exchange spring magnet, in which a permanent magnet phase (hard phase) and a soft magnet phase (soft phase) are coexisting in nano-size. The exchange spring magnet can improve magnetic properties due to a high magnetic flux density as a whole magnet, because it contains the soft phase with high magnetic flux density.

A method to produce a bonded magnet using an alloy thin ribbon, which has been subjected to heat treatment, is not specially limited. A bonded magnet is usually produced using alloy powder that is obtained by pulverizing the alloy thin ribbon. As for a pulverization method of alloy thin ribbon and a method for producing bonded magnet, known techniques can be suitably employed.

A second aspect of the present invention relates to an alloy thin ribbon for rare earth magnet that can be produced by the first aspect of the present invention. Specifically, in an second aspect of the present invention, the alloy thin ribbon is one obtainable by feeding a molten alloy containing praseodymium (Pr), iron (Fe), cobalt (Co), titanium (Ti), boron (B), and silicon (Si) on a rotating roll, then applying heat treatment to the resultant quenched thin ribbon at a programming rate within a range of 100° to 150° C./min, preferably 110° to 125° C./min to crystallize the quenched thin ribbon.

The alloy thin ribbon of the second aspect of the present invention is obtained according to the above production method, but the alloy thin ribbon is not limited to one that is produced according to the production method of the first aspect of the present invention. Any alloy thin ribbon produced by other production method can also be included within the technical scope of the present invention, so long as the alloy thin ribbon has the similar composition and structure as well as equivalent effect as in the alloy thin ribbon produced according to the production method of the first aspect of the present invention. The alloy thin ribbon of the present invention is superior in magnetic properties such as residual magnetic flux density (Br), coercive force (HcJ; HcB), and maximum energy product [(BH)max], as well as thermal stability.

Composition of the alloy thin ribbon is as described in the first aspect of the present invention. Namely, composition of the alloy thin ribbon is preferably $Pr_xFe_{90-x-z}Co_yTi_{1.5}B_zSi_{0.5}$ (x=10.0 to 13.0, y=8.0 to 12.0, and z=7.0 to 14.0). A composition of alloy thin ribbon within this range provides an alloy thin ribbon superior in residual magnetic flux density (Br), coercive force (HcJ; HcB), and maximum energy product [(BH)max].

Production conditions such as roll circumferential speed, and heating rate, heat treatment temperature and heat treatment time in the heat treatment are as described in the first aspect of the present invention. Specifically, preferable production conditions are as follows: roll circumferential speed: 7.5 to 15 m/sec; heating rate in heat treatment: 100° to 150° C./min, preferably 110° to 125° C./min; heat treatment temperature: 550° to 625° C.; and heat treatment time: 3 to 7 minutes. Detailed description of each condition is omitted here because they are described in the first aspect of the present invention.

Magnetic properties of the alloy thin ribbon may be isotropic or anisotropic. Further, the alloy thin ribbon is preferably an exchange spring magnet having an α-Fe type soft phase and a $Pr_2Fe_{14}B$ type hard phase in consideration of magnetic properties.

The alloy thin ribbon is composed of a number of crystal grains that preferably has a mean grain size of 16.0 to 84.4 nm. The mean grain size can be measured on an alloy thin ribbon using a transmission electron microscope (TEM). Specifically, the mean grain size is determined by optionally selecting 100 grains among crystal grains observed on a TEM photograph, measuring long diameter of each grain and calculating a mean value of the diameters.

Distribution of each element in the alloy thin ribbon is not specially limited, so long as the alloy thin ribbon functions as a magnet. However, preferably boron (B) segregates at the grain boundary of crystal grains in the alloy thin ribbon. Segregation of boron atom at the grain boundary of crystal grains is considered to enhance coercive force, though the reason is not clear.

"Segregation of boron at the grain boundary" means a state where more boron atoms are distributed at the grain boundary when distribution of boron element is studied. Boron is difficult to analyze due to a light element as known well, but can be determined using, for example, an EELS (Electronic Energy Loss Spectrometer, made by FEI Company Japan Ltd.).

Figure 2:
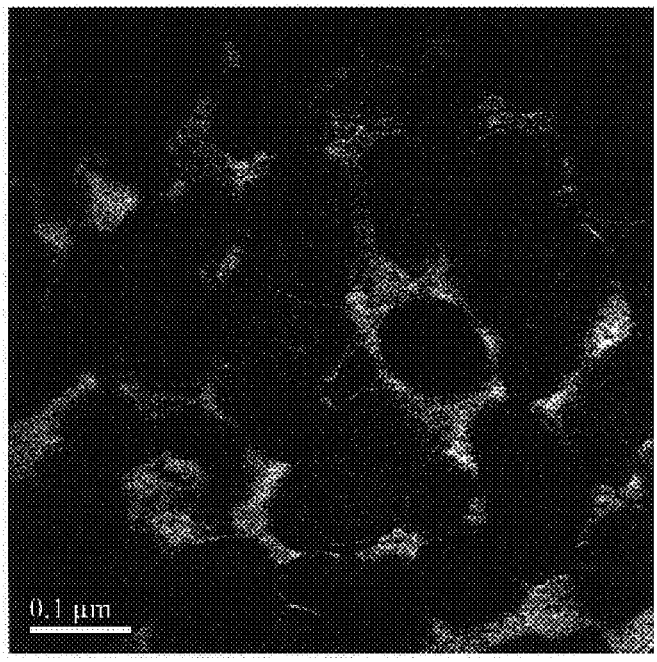
FIG. 2 shows a boron map of the alloy thin ribbon of FIG. 1.

For reference, a TEM photograph of an alloy thin ribbon of a certain composition with an enriched boron concentration to make boron analysis easy is shown in FIG. 1, and a boron map of the alloy thin ribbon is shown in FIG. 2. The boron map was made using an EELS (Electronic Energy Loss Spectrometer). In the photograph of FIG. 2, a brighter part means a site where B concentration is higher. From FIG. 2, it can be understood that boron is segregated at the grain boundary of crystal grains.

The alloy thin ribbon of the present invention is superior in magnetic properties such as coercive force. Specifically, the alloy thin ribbon preferably has coercive force HcJ of not less than 20 kOe (1.59 MA/m). Further, the alloy thin ribbon of the present invention is superior in thermal stability at a high temperature, and has a low irreversible demagnetization rate when exposed to a high temperature environment. Specifically, the alloy thin ribbon of the present invention has an irreversible demagnetization rate of preferably less than 6%, more preferably less than 5% when heated up to 150° C. The irreversible demagnetization rate can be calculated by the formula (F1−F2)×100/F1, based on a magnetic flux (F1) after pulse magnetization at, for example, 4.8 MA/m, and a magnetic flux (F2) after maintaining the alloy thin ribbon at a certain temperature. Magnetic flux can be measured by using a magnetic properties evaluation apparatus such as a digital fluxmeter. Maintaining of the alloy thin ribbon at a certain temperature can be conducted, for example, for 1 hour in a constant temperature bath.

Alloy powder can be obtained by pulverizing the alloy thin ribbon. The alloy powder is, after classification if necessary, mixed with a resin and molded to obtain a bonded magnet. Measures to produce a bonded magnet such as pulverization measure for alloy powder, particle size of the powder, and resin are not specially limited, but any known production method for the bonded magnet can be suitably used. As the resin, for example, an epoxy resin, a nylon resin and the like can be used. As for molding, any known measure such as compression molding and injection molding can be employed.

The bonded magnet of the present invention is superior in thermal resistance because it is made using magnet alloy superior in thermal resistance as a raw material. Specifically, the bonded magnet of the present invention has an irreversible demagnetization rate of preferably less than 6%, more preferably less than 5% when heated up to 150° C. The irreversible demagnetization rate can be calculated by the formula (F1−F2)×100/F1, based on a magnetic flux (F1) after pulse magnetization at, for example, 4.8 MA/m, and a magnetic flux (F2) after maintaining the bonded magnet at a certain temperature. Magnetic flux can be measured by using a magnetic properties evaluation apparatus such as a digital fluxmeter. Maintaining of the bonded magnet at a certain temperature can be conducted, for example, for 1 hour in a constant temperature bath.

A third aspect of the present invention relates to an alloy for rare earth magnet with a low irreversible demagnetization rate. Specifically, in the third aspect of the present invention, an alloy for rare earth magnet contains praseodymium (Pr), iron (Fe), cobalt (Co), titanium (Ti), boron (B), and silicon (Si) and has an irreversible demagnetization rate of less than 6%, preferably less than 5% when heated up to 150° C. The alloy may be thin ribbon-like or powdery. By using an alloy having a low irreversible demagnetization rate, which could not be obtained conventionally, a magnet superior in thermal stability can be produced. The magnet alloy is preferably superior in magnetic properties such as coercive force. Specifically, the magnet alloy preferably has coercive force HcJ of not less than 20 kOe (1.59 MA/m).

EXAMPLES

Effects of the present invention will be described below using the following Examples. However, technical scope of the present invention is not limited to the following Examples.

(Influences of Composition)

Relationships between composition of an alloy thin ribbon and magnetic properties were studied by varying composition of the alloy thin ribbon. Procedures to produce the alloy thin ribbons are as follows except that amounts of raw materials to be compounded were varied corresponding to the desired compositions.

A mother alloy containing Fe, Co, Ti and Si as a metal and B as a metalloid was prepared by a vacuum suction method. A quenched thin ribbon was prepared from a molten alloy obtained by melting the mother alloy using a single roll liquid quenching method. Preparation of the quenched thin ribbon was conducted in a high purity Ar gas atmosphere. A Cr-plated copper roll with a diameter of 300 mm was used at a roll circumferential speed of 10 m/sec. Feed of the molten alloy to the roll was carried out using a quartz injection tube with an orifice diameter of 0.5 mm, while injection gas pressure was kept constant at 30 kPa using high purity Ar gas during the injection.

The resultant quenched thin ribbon was subjected to heat treatment in a high purity Ar gas atmosphere using an infrared ray gold image furnace. Heating rate was 120° C./min, heat treatment temperature was 600° C., and heat treatment time was 5 min.

Firstly, in the composition of $Pr_xFe_{bal}Co_8Ti_{1.5}B_{10}Si_{0.5}$, x was varied within a range of 10.0 to 13.0. The results obtained are shown in Table 1. An amount of Ti was fixed at 1.5 because the maximum values of magnetic properties were observed at 1.5% by atom of Ti amount when magnetic properties were evaluated with Ti amount varied as 0.5, 1.0, 1.5 and 2.0% by atom. Si was added in an amount of 0.5% by atom to improve fluidity of a molten alloy.

After an alloy thin ribbon was subjected to pulse magnetization at 4.8 MA/m, residual magnetic flux density (Br), coercive force (HcJ; HcB), and maximum energy product [(BH)max] were measured at room temperature using a vibrating sample type magnetometer (VSM) made by Toei Industry Co., Ltd.

TABLE 1

Magnetic properties of $Pr_xFe_{bal}Co_8Ti_{1.5}B_{10}Si_{0.5}$

| X | Br (T) | HcJ (kA/m) | HcB (kA/m) | (BH) max (kJ/m$^3$) |
|---|---|---|---|---|
| 10.0 | 0.8500 | 1003 | 557 | 120 |
| 11.0 | 0.8000 | 1568 | 549 | 111 |

TABLE 1-continued

| | Magnetic properties of $Pr_xFe_{bal}Co_8Ti_{1.5}B_{10}Si_{0.5}$ | | | |
|---|---|---|---|---|
| X | Br (T) | HcJ (kA/m) | HcB (kA/m) | (BH) max (kJ/m$^3$) |
| 12.0 | 0.7657 | 1591 | 539 | 104 |
| 13.0 | 0.7219 | 1592 | 511 | 92.0 |

Figure 3:
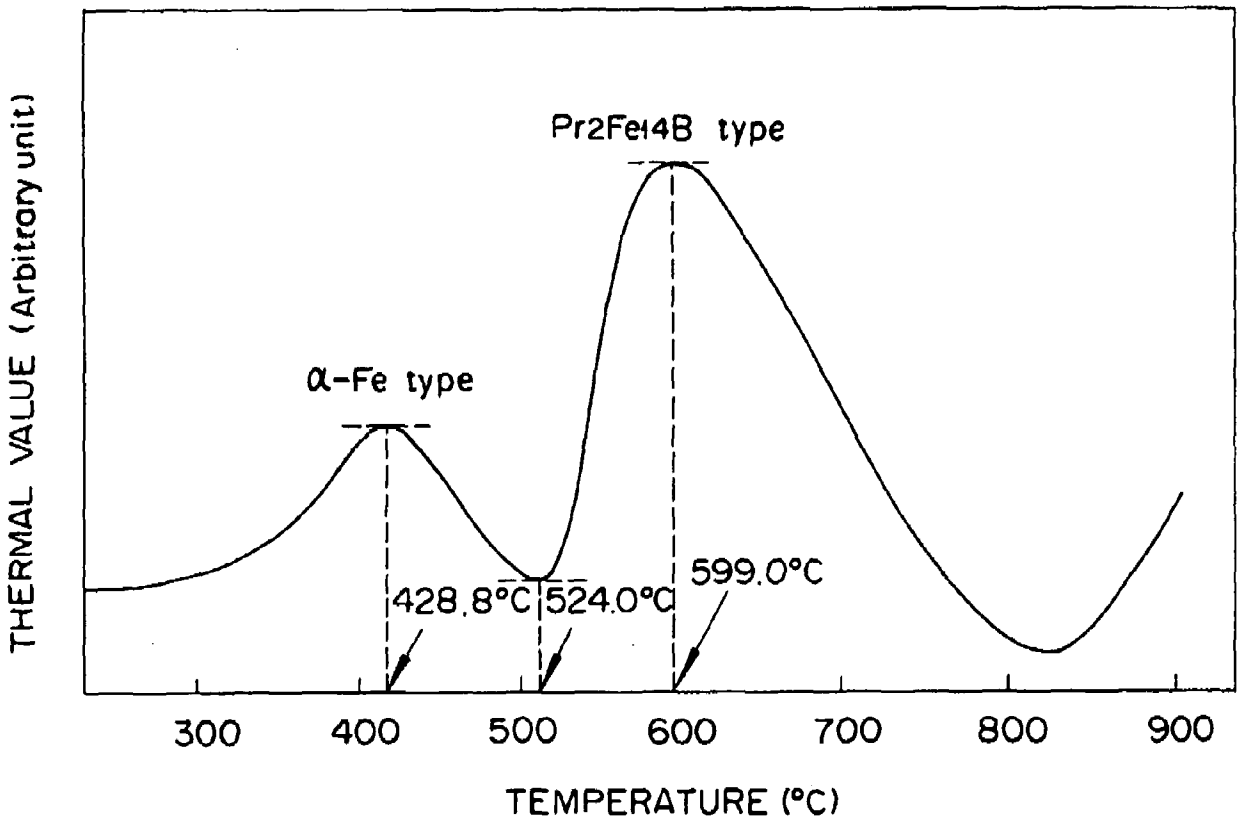
FIG. 3 shows a DTA curve for an alloy thin ribbon with a composition of $Pr_{11}Fe_{68.5}Co_8Ti_{1.5}B_{10.5}Si_{0.5}$.

A DTA curve of an alloy thin ribbon having a composition of Pr11Fe68.5Co8Ti1.5B10.5Si0.5 is shown in FIG. 3. Measurement of the DTA curve was carried out using a differential thermal analyzer made by Rigaku Corp. at a heating rate of 20° C./min. Identification of each crystal phase was performed by applying heat treatment to a quenched thin ribbon sample at a low temperature, followed by rapidly cooling down to room temperature after reaching the exothermic peak temperatures, then confirming which exothermic peak corresponds to which crystal phase through a study by a X-ray diffraction analysis. From the figure, a crystallization-initiating temperature of a Pr2Fe14B type crystal phase, which acts as a hard phase, was found to be about 520° C., suggesting a guideline that heat treatment for the composition series should be conducted at a temperature not lower than 550° C. Further, exothermic reactions between an α-Fe type crystal phase, which acts as a soft phase, and a Pr2Fe14B type crystal phase were observed.

Secondly, in the composition of $Pr_xFe_{bal}Co_8Ti_{1.5}B_{9.5}Si_{0.5}$, x was varied within a range of 10.0 to 12.0. The results obtained are shown in Table 2.

TABLE 2

| | Magnetic properties of $Pr_xFe_{bal}Co_8Ti_{1.5}B_{9.5}Si_{0.5}$ | | | |
|---|---|---|---|---|
| X | Br (T) | HcJ (kA/m) | HcB (kA/m) | (BH) max (kJ/m$^3$) |
| 10.0 | 0.8836 | 885.7 | 562 | 127 |
| 11.0 | 0.8164 | 1308 | 567 | 116 |
| 12.0 | 0.7594 | 1592 | 535 | 102 |

Then, in the composition of $Pr_xFe_{bal}Co_8Ti_{1.5}B_{9.5}Si_{0.5}$, x was varied within a range of 10.0 to 12.0. The results obtained are shown in Table 3.

TABLE 3

| | Magnetic properties of $Pr_xFe_{bal}Co_8Ti_{1.5}B_{11.5}Si_{0.5}$ | | | |
|---|---|---|---|---|
| X | Br (T) | HcJ (kA/m) | HcB (kA/m) | (BH) max (kJ/m$^3$) |
| 10.0 | 0.8626 | 717 | 485 | 114 |
| 11.0 | 0.7505 | 1592 | 523 | 98 |
| 12.0 | 0.7298 | 1592 | 517 | 94 |

Then, in the composition of $Pr_xFe_{bal}Co_yTi_{1.5}B_{10.5}Si_{0.5}$, y was varied within a range of 8.0 to 12.0. The results obtained are shown in Table 4.

TABLE 4

| | Magnetic properties of $Pr_{11}Fe_{bal}Co_yTi_{1.5}B_{10.5}Si_{0.5}$ | | | |
|---|---|---|---|---|
| y | Br (T) | HcJ (kA/m) | HcB (kA/m) | (BH) max (kJ/m$^3$) |
| 8.0 | 0.8000 | 1568 | 549 | 111 |
| 10.0 | 0.7901 | 1592 | 551 | 109 |
| 12.0 | 0.7873 | 1592 | 544 | 107 |

Finally, in the composition of $Pr_{13}Fe_{bal}Co_8Ti_{1.5}B_zSi_{0.5}$, z was varied within a range of 7.0 to 14.0. The results obtained are shown in Table 5.

TABLE 5

| | Magnetic properties of $Pr_{13}Fe_{bal}Co_8Ti_{1.5}B_zSi_{0.5}$ | | | |
|---|---|---|---|---|
| z | Br (T) | HcJ (kA/m) | HcB (kA/m) | (BH) max (kJ/m$^3$) |
| 7.0 | 0.8240 | 1446 | 574 | 118 |
| 10.5 | 0.7219 | 1592 | 511 | 92 |
| 14.0 | 0.6656 | 1671 | 459 | 75 |

(Influences of Heating Rate)

Figure 4:
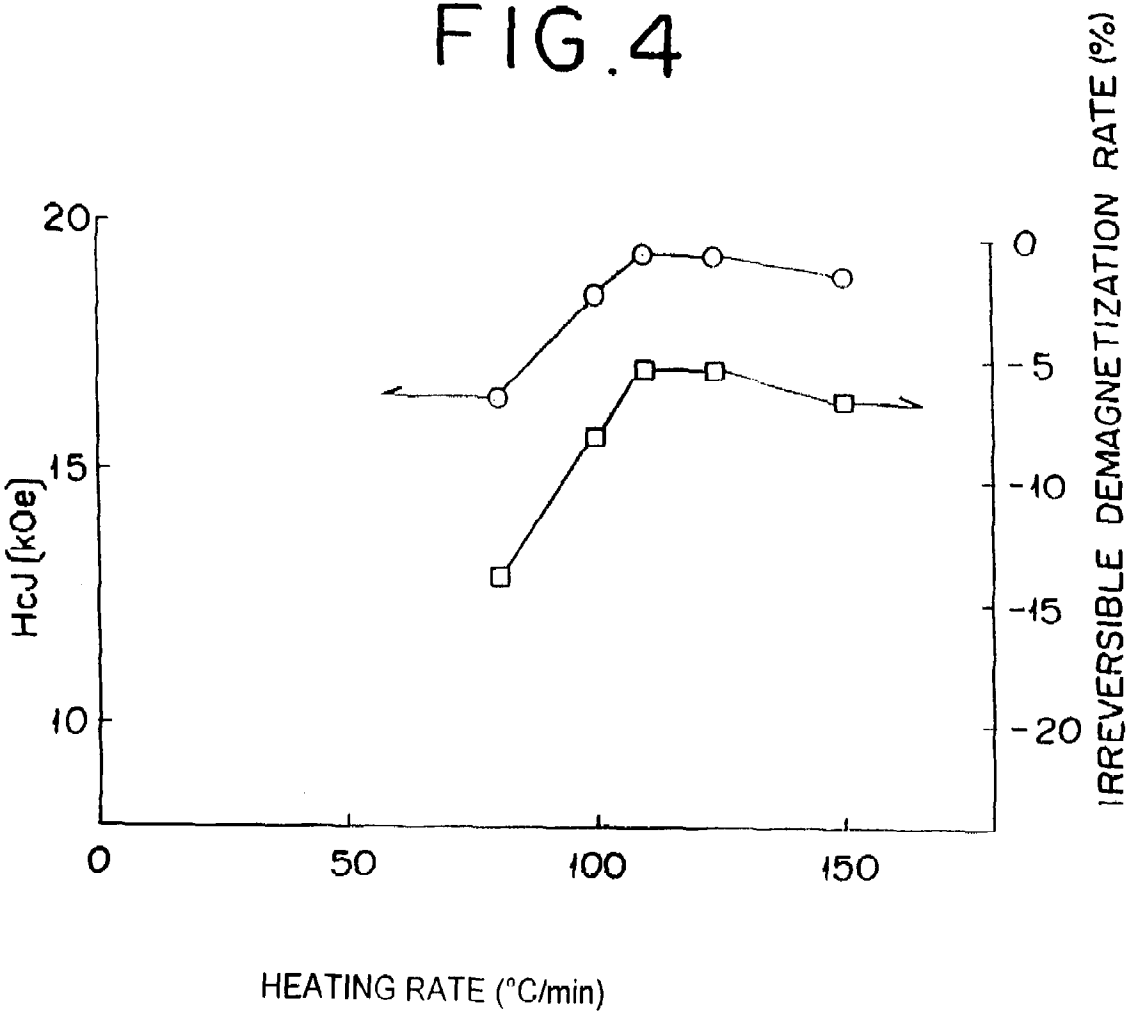
FIG. 4 is a graph showing relationships between heating rate and magnetic properties.

Alloy thin ribbons having a composition of Pr11Fe68.5Co8Ti1.5B10.5Si0.5 were prepared according to the method described in "Influences of composition" except that heating rate in the heat treatment was varied. The results obtained are shown in FIG. 4. As shown in the figure, a programming rate within a range of 100° to 150° C./min gave an alloy thin ribbon having superior magnetic properties. A heating rate within a range of 110° to 125° C./min gave an alloy thin ribbon having more superior magnetic properties.

(Influences of Roll Circumferential Speed)

Figure 5:
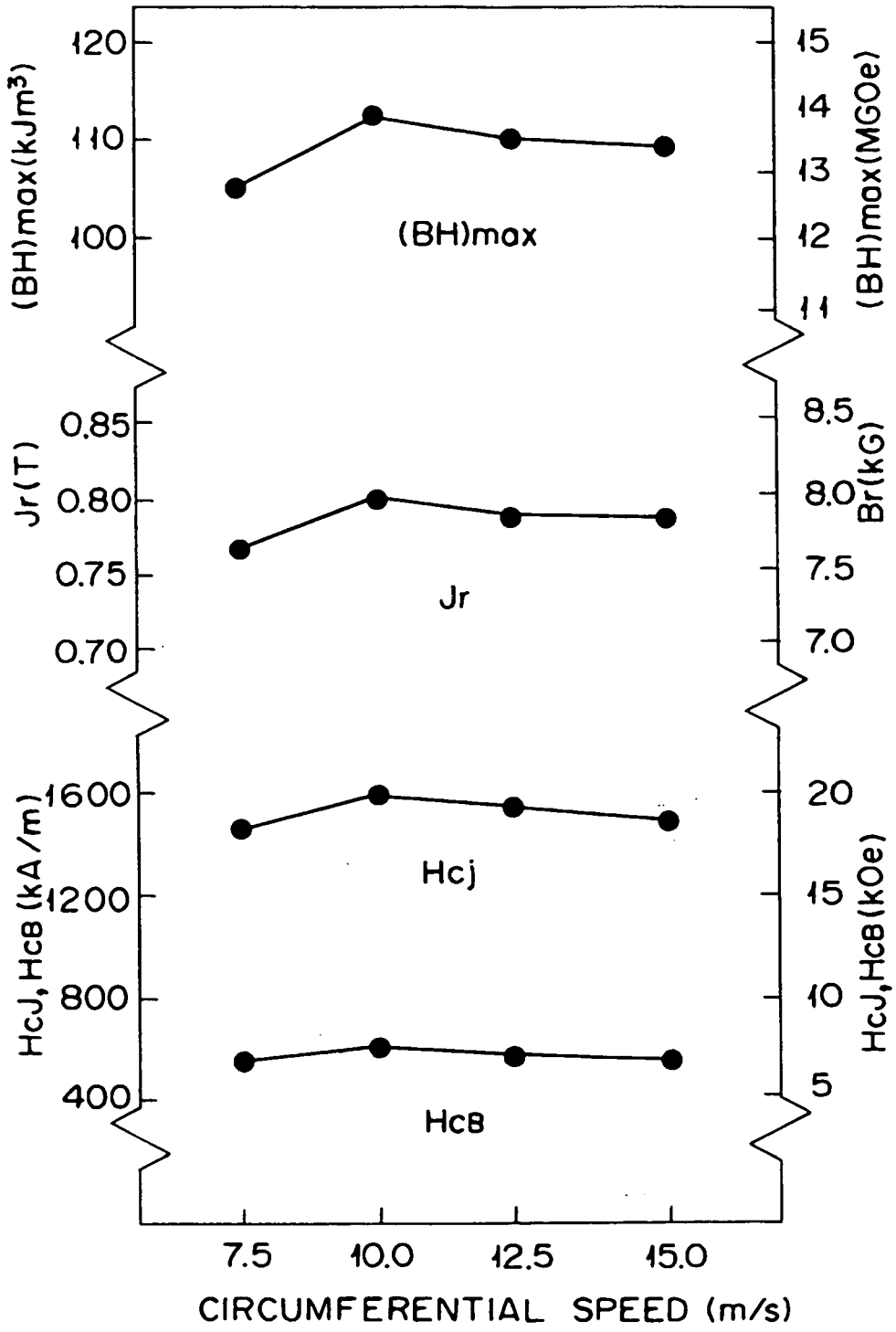
FIG. 5 is a graph showing relationships between roll circumferential speed and magnetic properties.

Alloy thin ribbons having a composition of $Pr_{11}Fe_{68.5}Co_8Ti_{1.5}B_{10.5}Si_{0.5}$ were prepared according to the method described in "Influences of composition" except that roll circumferential speed was varied. A roll circumferential speed was varied within a range of 7.5 to 15.0 m/sec The results obtained are shown in FIG. 5. As shown in the figure, a roll circumferential speed within a range of 7.5 to 15.0 m/sec gave an alloy thin ribbon having superior magnetic properties. A roll circumferential speed giving the most superior magnetic properties was 10.0 m/sec.

(Influences of Heat Treatment Temperature)

Figure 6:
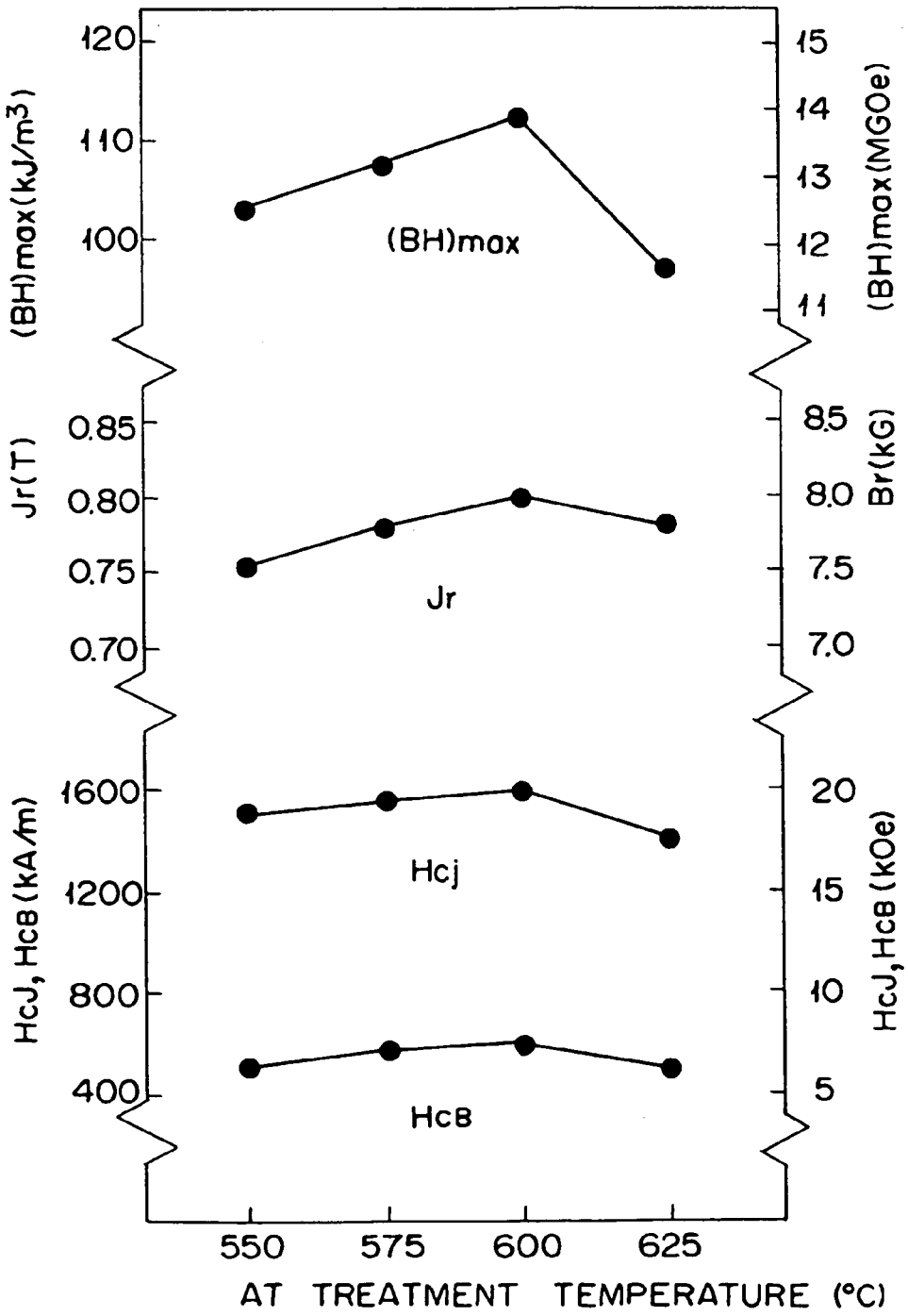
FIG. 6 is a graph showing relationships between heat treatment temperature and magnetic properties.

Alloy thin ribbons having a composition of $Pr_{11}Fe_{68.5}Co_8Ti_{1.5}B_{10.5}Si_{0.5}$ were prepared according to the method described in "Influences of composition" except that heat treatment temperature was varied. The heat treatment temperature was varied within a range of 550° to 625° C. The results obtained are shown in FIG. 6. As shown in the figure, a heat treatment temperature within a range of 550° to 625° C. gave an alloy thin ribbon having superior magnetic properties. A heat treatment temperature giving the most superior magnetic properties was 600° C. In a case where a heat treatment temperature is lower than 550° C., it was difficult to secure superior magnetic properties. The reason can be understood from the results of DTA shown in FIG. 3.

Figure 7:
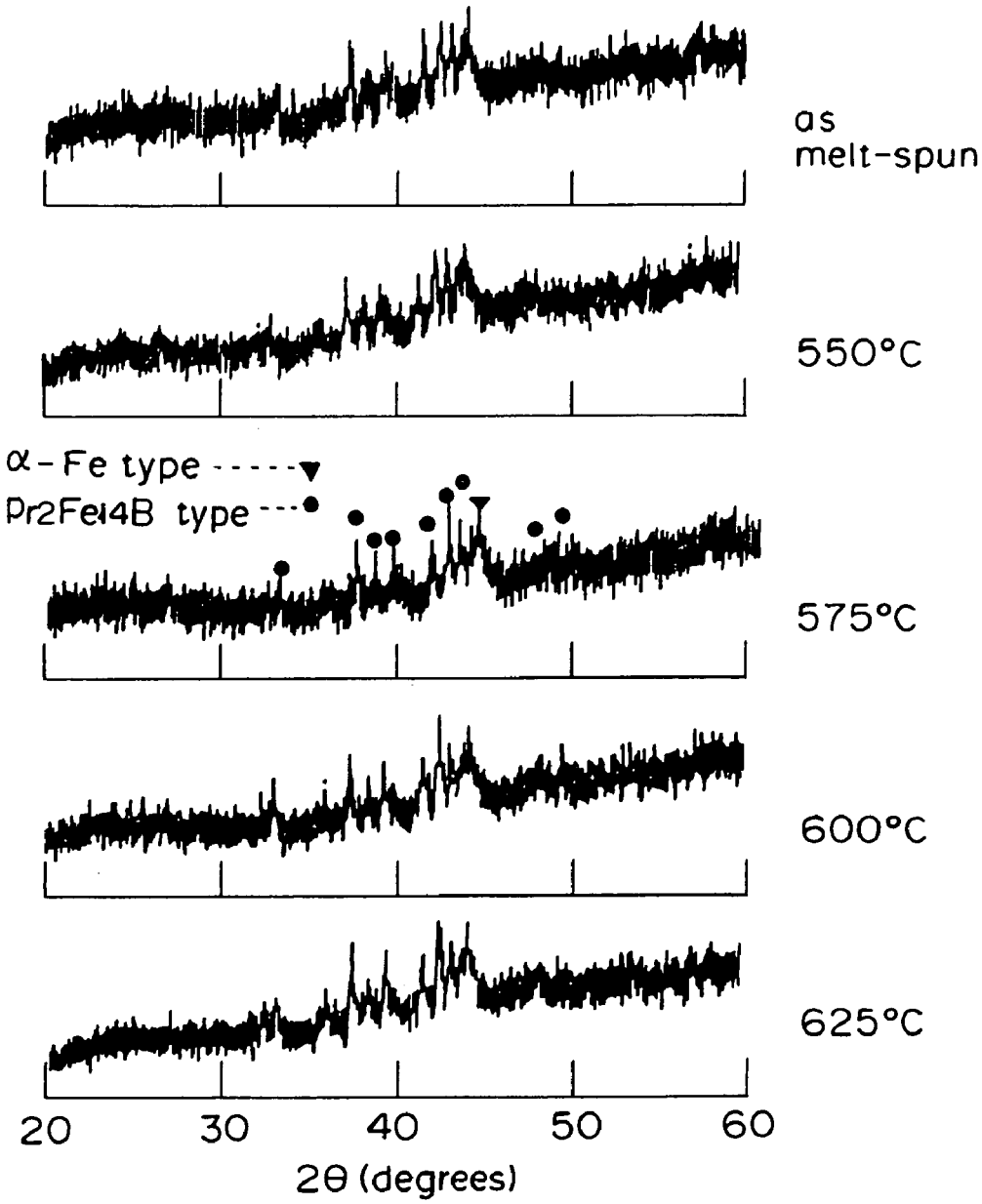
FIG. 7 shows X-ray diffraction patterns of alloy thin ribbons obtained by applying heat treatments at 550° C., 575° C., 600° C. and 625° C.

In FIG. 7, X-ray diffraction patterns at 550° C., 575° C., 600° C. and 625° C. are shown. From these figures, it is understood that the alloy thin ribbon as melt-spun is almost in an amorphous state. Furthermore, at all heat treatment temperatures tested, a $Pr_2Fe_{14}B$ type crystal phase and an α-Fe type crystal phase were observed indicating that the alloy thin ribbons were made of a composite structure.

(Influences of Heat Treatment Time)

Figure 8:
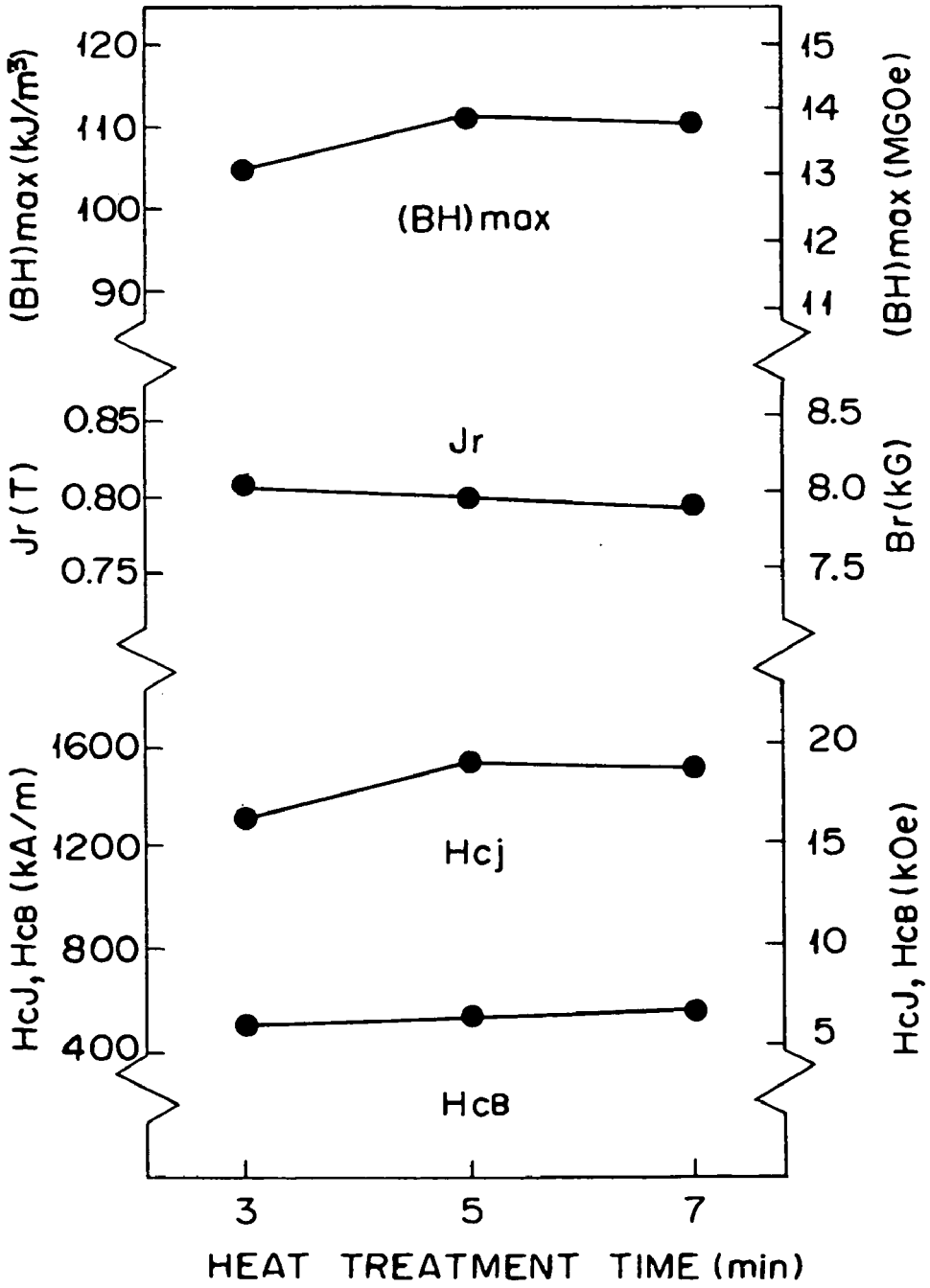
FIG. 8 is a graph showing relationships between heat treatment time and magnetic properties.

Alloy thin ribbons having a composition of $Pr_{11}Fe_{68.5}Co_8Ti_{1.5}B_{10.5}Si_{0.5}$ were prepared according to the method described in "Influences of composition" except that heat treatment time was varied. The heat treatment time was varied as 3 minutes, 5 minutes and 7 minutes. The results obtained are shown in FIG. 8. As shown in the figure, a heat treatment time within a range of 3 to 7 minutes gave an alloy thin ribbon having superior magnetic properties. A heat treatment time giving the most superior magnetic properties was 5 minutes.

(Influences of Grain Size of Crystal Grain)

Figure 9:
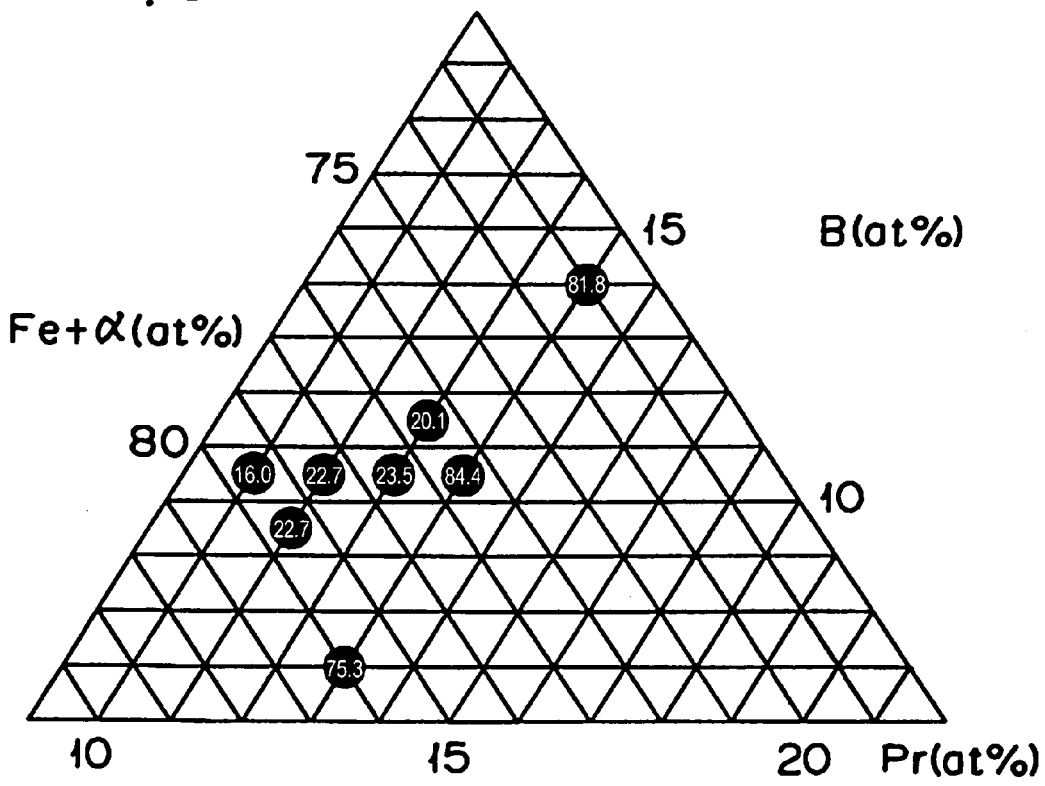
FIG. 9 is a chart showing a relationship between composition and mean grain size for a composition of $Pr_xFe_{90-x-z}Co_8Ti_{1.5}B_zSi_{0.5}$.

Alloy thin ribbons having a composition of $Pr_xFe_{90-x-z}Co_8Ti_{1.5}B_zSi_{0.5}$ were prepared by varying values of x, y and z, and mean grain sizes of these alloy thin ribbons were measured using a transmission type electron microscope (TEM). Mean grain size was obtained by optionally selecting 100 crystal grains among a number of crystal grains observed on a TEM photograph, measuring long diameter of each crystal grain, and calculating a mean value of the diameters. The results obtained are shown in FIG. 9. In the figure, each number enclosed by a circle show a mean grain size of the prescribed composition. All of the resultant alloy thin ribbons showed superior magnetic properties having mean grain sizes within a range of 16.0 to 84.0 nm.

The mean grain size of crystal grains for a composition with 11 to 12% by atom of Pr amount and 9.5 to 11.5% by atom of B amount was comparatively small as 20 to 23 nm, whereas the mean grain size for a composition with 13% by atom of Pr amount and 7 to 14% by atom of B amount was larger as 75 to 84 nm. The latter composition gave a larger value of coercive force as 1.67 MA/m in spite of the larger grain size. Elemental distributions of Pr, Fe and B were studied to clarify the reason of the high coercive force, and it was found that boron was segregated at the grain boundary of crystal grains. Segregation of boron at the grain boundary of crystal grain is considered to cause the high coercive force.

(Magnetic Properties of $Pr_{11}Fe_{68.5}Co_8Ti_{1.5}B_{10.5}Si_{0.5}$)

In the range where experiments were carried out, the most optimum magnetic properties were obtained under the following conditions: composition=$Pr_{11}Fe_{68.5}Co_8Ti_{1.5}B_{10.5}Si_{0.5}$, roll circumferential speed=10.0 m/sec, heat treatment temperature=600° C., and heat treatment time=5 min. Several properties under these conditions will be shown below.

Figure 10:
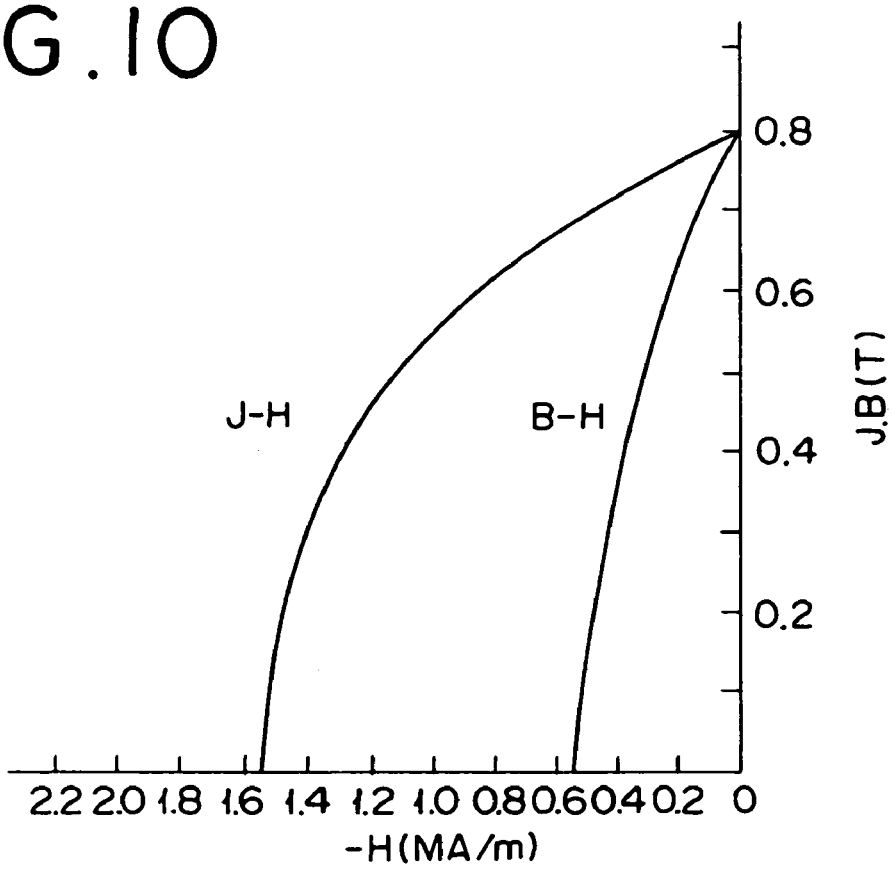
FIG. 10 shows demagnetization curves of an alloy thin ribbon with a composition of $Pr_{11}Fe_{68.5}Co_8Ti_{1.5}B_{10.5}Si_{0.5}$ produced under the conditions of roll circumferential speed: 10.0 m/sec, heat treatment temperature: 600° C., and heat treatment time: 5 min.

FIG. 10 shows demagnetization curves of the alloy thin ribbon obtained. Magnetic properties thereof were as follows: Jr=0.8T (8.0 kG), HcJ=1.57 MA/m, (19.7 kOe), HcB=0.55 MA/m (6.9 kOe), (BH)max=111.2 kJ/m$^3$ (13.9 MGOe).

Figure 11:
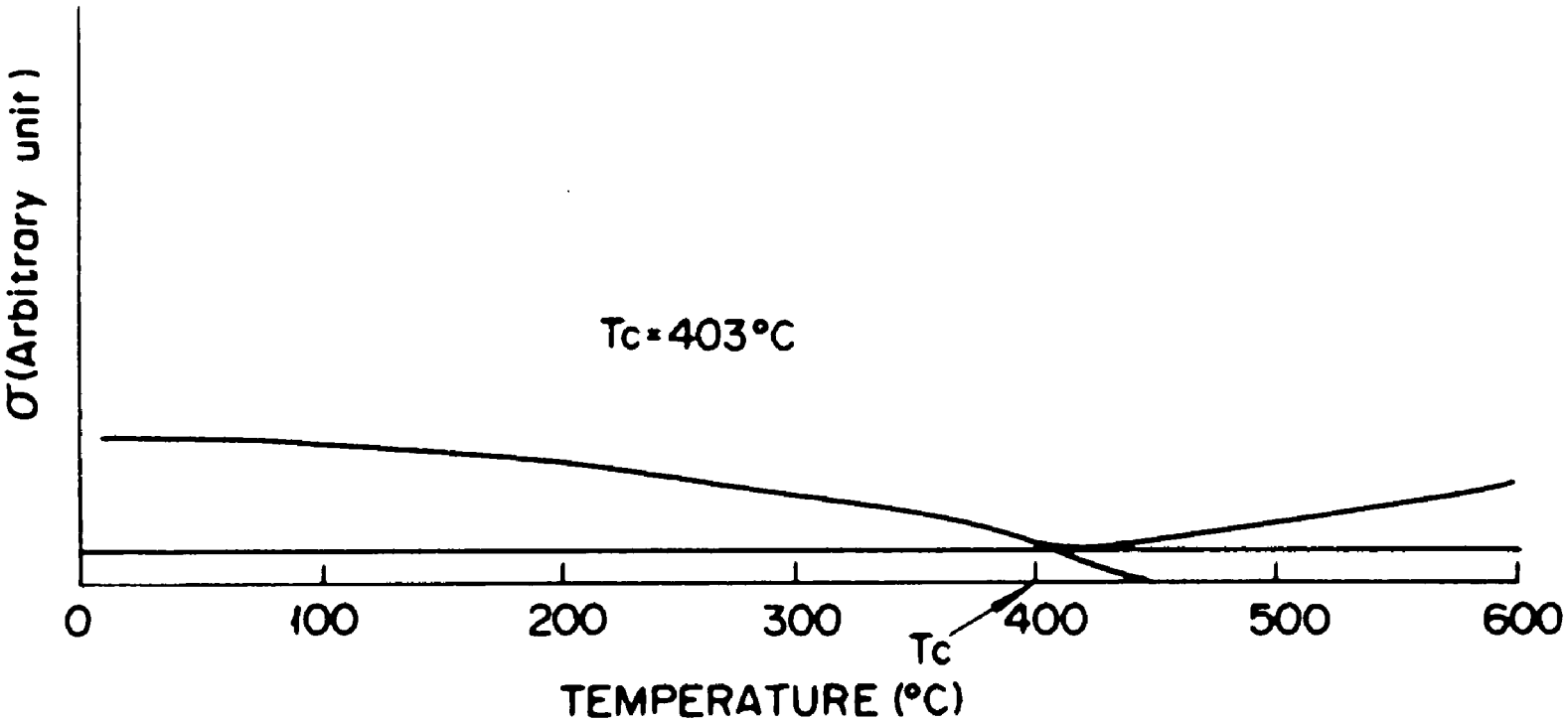
FIG. 11 shows a σ-T curve of an alloy thin ribbon with a composition of $Pr_{11}Fe_{68.5}Co_8Ti_{1.5}B_{10.5}Si_{0.5}$ produced under the conditions of roll circumferential speed: 10.0 m/sec, heat treatment temperature: 600° C., and heat treatment time: 5 min.

FIG. 11 shows an σ-T curve of the alloy thin ribbon obtained. Samples were magnetized at 4.8 MA/m in advance, and measurements were conducted using a vibrating sample type magnetometer (VSM). Magnetic field for measurement was 0 A/m. From FIG. 11, Curie temperature of the sample and an amount of α-Fe type crystal phase therein can be found to be 403° C. and 19%, respectively.

Figure 12:
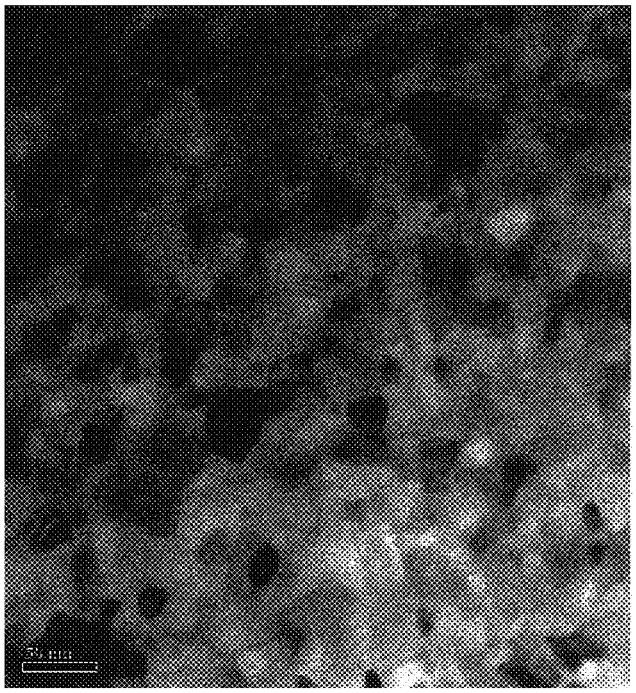
FIG. 12 is a TEM photograph of an alloy thin ribbon with a composition of $Pr_{11}Fe_{68.5}Co_8Ti_{1.5}B_{10.5}Si_{0.5}$ produced under the conditions of roll circumferential speed: 10.0 m/sec, heat treatment temperature: 600° C., and heat treatment time: 5 min.
Figure 13:
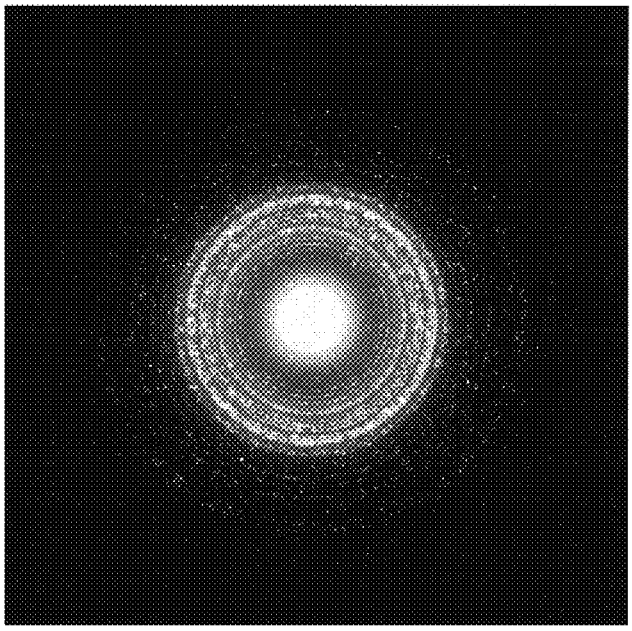
FIG. 13 is an electron beam diffraction photograph of an alloy thin ribbon with a composition of $Pr_{11}Fe_{68.5}Co_8Ti_{1.5}B_{10.5}Si_{0.5}$ produced under the conditions of roll circumferential speed: 10.0 m/sec, heat treatment temperature: 600° C., and heat treatment time: 5 min (FIG. 12).

FIG. 12 is a TEM photograph of the alloy thin ribbon obtained. Crystal grains with a size of around 14 to 36 nm were observed, and a mean grain size thereof was 23 nm. Further, FIG. 13 is an electron beam diffraction photograph. From the photograph, it is found that the alloy thin ribbon obtained is isotropic.

(Measurement of Irreversible Demagnetization Rate)

A bonded magnet was produced using an alloy thin ribbon prepared by varying Co amount y as 8, 11, 12 at % in a composition of $Pr_{11}Fe_{76.5-y}Co_yTi_{1.5}B_{10.5}Si_{0.5}$. Firstly, each alloy thin ribbon was pulverized to a size of not larger than 150 μm to obtain alloy powder, followed by mixing with 2.5% by weight of an epoxy resin, which is a heat resistant resin acting as a binder, molding by a compression molding at a pressure of 980 MPa. After that, curing was carried out at 180° C. for 1 hour to obtain isotropic bonded magnets with a diameter of 10 mm and a length of 7.8 mm. Magnetic properties of each bonded magnet were measured using a high sensitive automatic recording fluxmeter (made by Toei Industry Co., Ltd.) after subjecting the bonded magnets to pulse magnetization at 4.8 MA/m.

Figure 14:
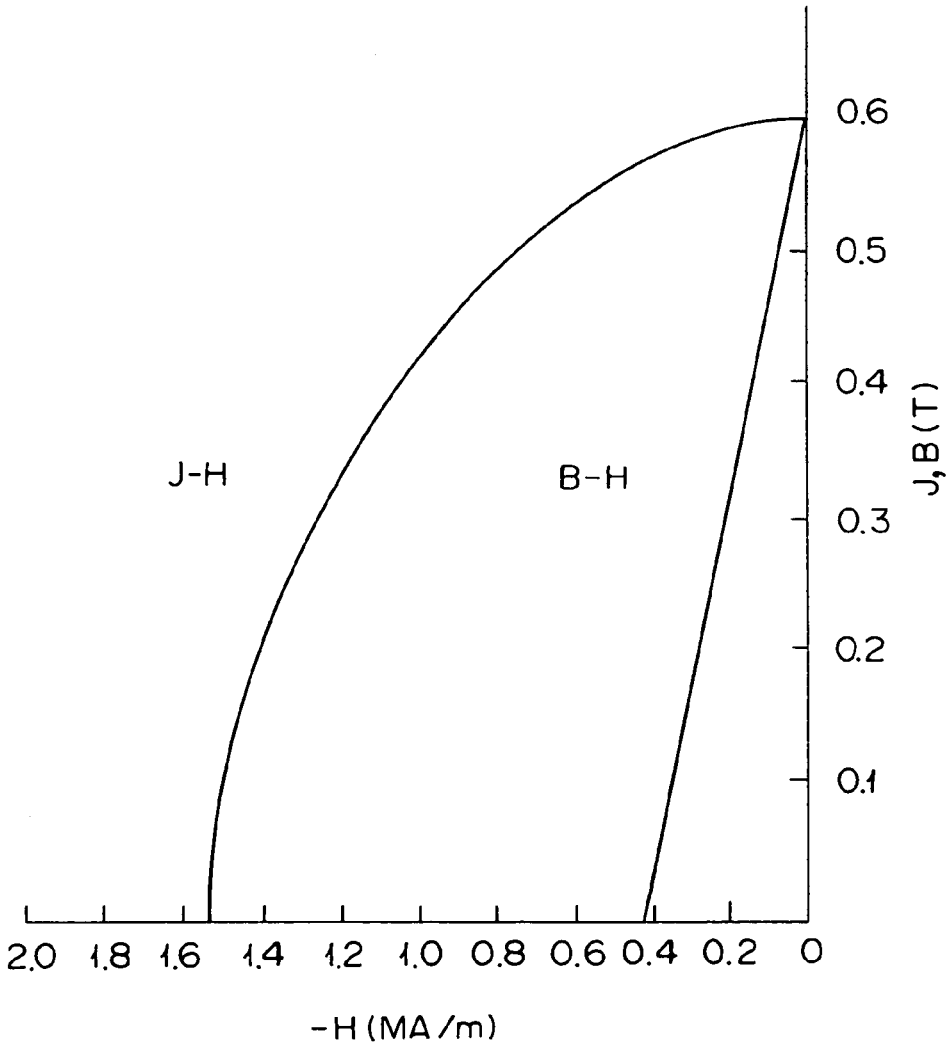
FIG. 14 shows demagnetization curves of bonded magnets with a composition of $Pr_{11}Fe_{68.5}Co_8Ti_{1.5}B_{10.5}Si_{0.5}$.

For reference, demagnetization curves of the bonded magnet having a composition of $Pr_{11}Fe_{68.5}Co_8Ti_{1.5}B_{10.5}Si_{0.5}$ are shown in FIG. 14. Density of this bonded magnet was 6.22 Mg/m$^3$. In addition, values of magnetic properties were as follows: Jr=0.60 T (6.0 kG), HcJ=1.54 MA/m (19.4 kOe), HcB=0.42 MA/m (5.2 kOe), and (BH)max=66.8 kJ/m$^3$ (8.4 MGOe).

An irreversible demagnetization rate of each bonded magnet was determined as follows. Firstly, magnetic flux (F1) of a bonded magnet after pulse magnetization at 4.8 MA/m was measured using a digital fluxmeter (made by Toei Industry Co., Ltd.). Subsequently, after maintaining the bonded magnet at a prescribed temperature for 1 hour in a constant temperature bath, then cooling in air for 1 hour, magnetic flux (F2) of the bonded magnet was measured. Based on these measurement results, an irreversible demagnetization rate (%) was calculated by the formula (F1−F2)×100/F1.

Figure 15:
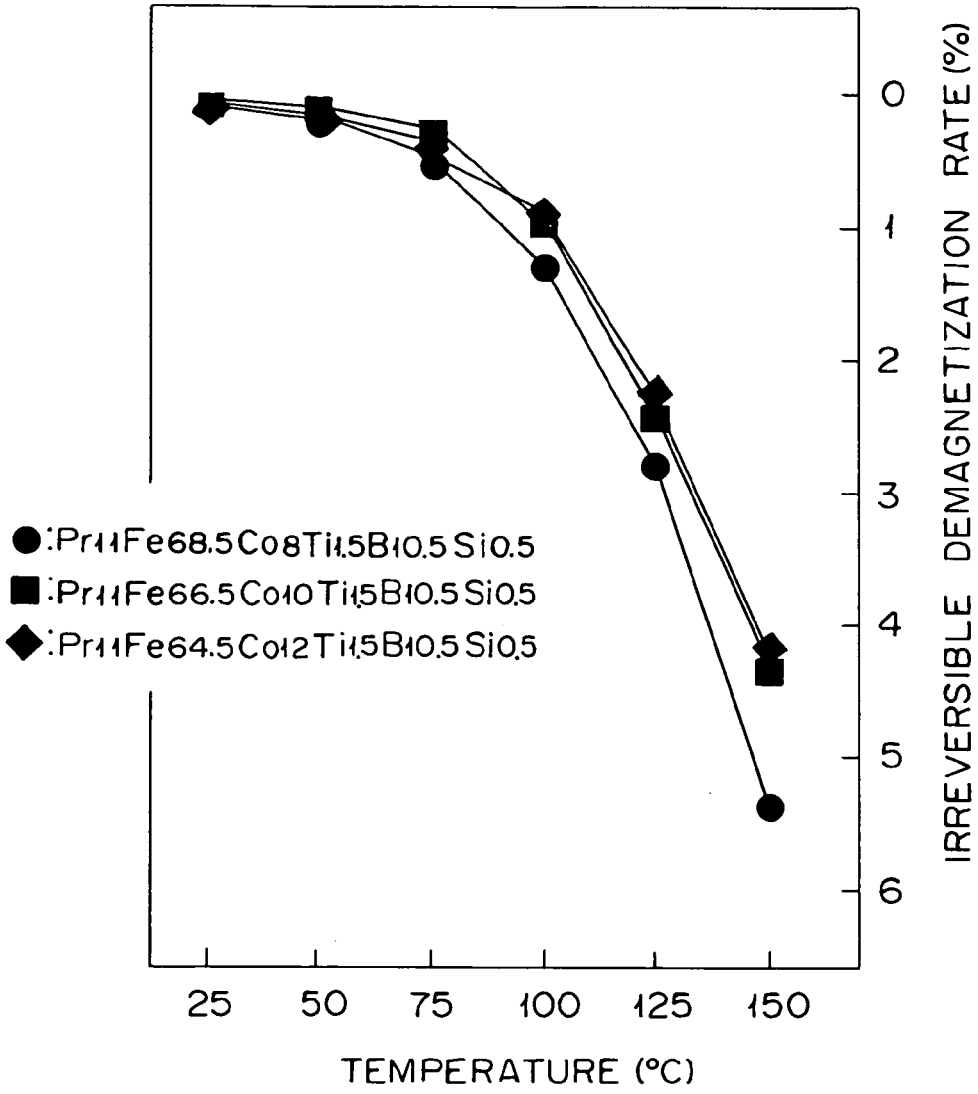
FIG. 15 is a graph showing temperature dependencies of irreversible demagnetization rate for bonded magnets produced.

Magnetic properties and irreversible demagnetization rates at 150° C. of the bonded magnets prepared are shown in Table 6. Further, temperature dependencies of irreversible demagnetization rate of the prepared bonded magnets are shown in FIG. 15. As apparent from the figure, demagnetization rate of a bonded magnet of the present invention is not higher than about −5.4% at 150° C.

For comparison, an alloy thin ribbon was prepared with a composition of $(Nd_{0.75}Pr_{0.2}Dy_{0.05})_{8.9}Fe_{bal}Co_{8.0}B_{5.7}$ that is used in JP-3277932. Roll circumferential speed, heat treatment conditions and preparation conditions of the bonded magnet were same to those of the method described in "Influences of composition" and the above-described production method for a bonded magnet. Density of the resultant bonded magnet was nearly same. Irreversible demagnetization rate of this bonded magnet at 150° C. was −13.4%. The results obtained are shown in Table 6 together with magnetic properties thereof for comparison.

TABLE 6

| Composition | Br (T) | HcJ (MA/m) | (BH) Max (kJ/m$^3$) | Density (Mg/m$^3$) | Irreversible Demagnetization Rate (%) at 150° C. |
|---|---|---|---|---|---|
| $Pr_{11}Fe_{68.5}Co_8Ti_{1.5}B_{10.5}Si_{0.5}$ | 0.60 | 1.54 | 66.8 | 6.22 | −5.4 |
| $Pr_{11}Fe_{66.5}Co_{10}Ti_{1.5}B_{10.5}Si_{0.5}$ | 0.64 | 1.43 | 69.7 | 6.27 | −4.3 |
| $Pr_{11}Fe_{64.5}Co_{12}Ti_{1.5}B_{10.5}Si_{0.5}$ | 0.64 | 1.61 | 69.6 | 6.31 | −4.2 |
| $(Nd_{0.75}Pr_{0.2}Dy_{0.05})_{8.9}Fe_{bal}Co_{8.0}B_{5.7}$ | 0.77 | 0.528 | 79.2 | 6.22 | −13.4 |

The entire disclosure of Japanese Patent Application No. 2004-242680 filed on Aug. 23, 2004 including specification, claims, drawings, and summary are incorporated herein by reference in its entirety.

The invention claimed is:

1. A production method of an alloy thin ribbon for a rare earth magnet comprising:

obtaining a quenched thin ribbon by feeding a molten alloy having a composition consisting essentially of $Pr_xFe_{90-x-z}Co_yTi_{1.5}B_zSi_{0.5}$ (x=10.0 to 13.0, y=8.0 to 12.0, and z=7.0 to 14.0) on a rotating roll; and applying heat treatment to said quenched thin ribbon at a heating rate within a range of 100° to 150° C./min to crystallize said quenched thin ribbon.

2. A production method according to claim 1, wherein a roll circumferential speed of said roll is 7.5 to 15 m/sec.

3. A production method according to claim 1, wherein a heat treatment temperature of said heat treatment is 550° to 625° C.

4. A production method according to claim 1, wherein a heat treatment time of said heat treatment is 3 to 7 minutes.

* * * * *